US005479803A

United States Patent [19]

Imanari

[11] Patent Number: 5,479,803

[45] Date of Patent: Jan. 2, 1996

[54] CONTROL APPARATUS FOR A CONTINUOUS HOT ROLLING MILL

[75] Inventor: Hiroyuki Imanari, Chofu, Japan

[73] Assignee: Kabushiki Kaisha Toshiba, Kawasaki, Japan

[21] Appl. No.: 77,928

[22] Filed: Jun. 18, 1993

[30] Foreign Application Priority Data

Jun. 19, 1992 [JP] Japan ..... 4-161346

[51] Int. Cl.[6] ..... B21B 37/12

[52] U.S. Cl. ..... 72/8; 72/16; 72/205; 72/234; 364/472

[58] Field of Search ..... 72/6–9, 11, 12, 72/16, 17, 205, 234; 364/149, 472

[56] References Cited

U.S. PATENT DOCUMENTS

| | | | |
|---|---|---|---|
| 3,416,339 | 12/1968 | List | 72/234 |
| 4,292,825 | 10/1981 | Morooka et al. | 72/8 |
| 4,507,946 | 4/1985 | Koyama et al. | 72/205 |

FOREIGN PATENT DOCUMENTS

| | | | |
|---|---|---|---|
| 0001407 | 1/1986 | Japan | 72/6 |
| 0214818 | 9/1987 | Japan | 72/8 |
| 0044503 | 2/1989 | Japan | 72/8 |
| 0057303 | 3/1989 | Japan | 364/149 |
| 0315801 | 12/1989 | Japan | 364/151 |
| 2-211906 | 8/1990 | Japan . | |

*Primary Examiner*—Lowell A. Larson
*Assistant Examiner*—Thomas C. Schoeffler
*Attorney, Agent, or Firm*—Oblon, Spivak, McClelland, Maier & Neustadt

[57] ABSTRACT

A setting means sets variables for expressing the process model, a target thickness value of the rolled material, a target interstand tension value of the rolled material, variables for responses of the thickness and the interstand tension and variables for adjusting the responses of a control system for controlling the thickness and the interstand tension. A control gain arithmetic means obtains control gains as numeric values by substituting the set variables into predetermined control gain operation expressions. A control arithmetic means calculates the speed command values and the roll gap command values for causing the thickness to follow up the target thickness and the interstand tension to follow up the target interstand tension while reducing an interaction between the thickness and the interstand tension by use of the calculated control gains.

6 Claims, 4 Drawing Sheets

CONTROL APPARATUS FOR A CONTINUOUS HOT ROLLING MILL

BACKGROUND OF THE INVENTION

1. Field of the Invention

The present invention relates to a control apparatus for a continuous hot rolling mill for controlling a thickness of a rolled material on each stand of a tandem rolling mill, an interstand tension and a height of each of loopers disposed between the respective stands.

2. Related Background Art

The thickness of a strip is defined as a part of the criteria for evaluating the final product in both hot rolling and cold rolling. This thickness is one of the most essential properties in the product. Previous methods of thickness control have included gauge meter AGC (Automatic Gauge Control), MMC (Mill Modulus Control) and X-ray monitor AGC.

Particularly, the rolled material in the hot rolling is weak in terms of resistance to deformation at high temperature. If the tension thereof is large, the rolled material is easily ruptured. Because of this, a hot rolling mill includes loopers. The tension is controlled by the looper, and the looper height is controlled in terms of enhancing a transferability of the material.

When a roll gap is controlled for improving accuracy of thickness over the rolled material, the interstand tension or the looper height fluctuates. Further, there exists such relationships that the fluctuation in the tension leads to a fluctuation in the thickness; and if the looper height fluctuates, the tension fluctuates as well as causing a fluctuation in the thickness.

According to the thickness control in the prior art, the tension of the rolled material and the looper height have been controlled by the PI control without restraining an interference between the tension and the looper height.

On the other hand, Japanese Patent Laid-Open Publication No. 2-211906 discloses a control method which involves an application of so-called LQ (Linear Quadratic) control for determining control gains by an evaluation function in the quadratic form to control the thickness, the interstand tension and the looper height in combination.

As explained earlier, according to the thickness control such as the gauge meter AGC, etc., the roll gap is independently controlled without employing a value of tension of the rolled material which influences the thickness. Consequently, a manipulated variable becomes excessive enough to induce an interference. This may result in a response concomitant with a large overshoot. Further, the thickness and roll gap values are also not used in the tension control. A speed change quantity of a rolling mill driving main motor is additionally calculated as a manipulated variable of the tension control. The response, however still tends to contain a large overshoot.

Further, the method based on the LQ control theory poses difficulty in determining a causality between a weight matrix Q and R in the following evaluation function J and an actual process response. A general practice is to determine the control gains by seeking Q and R in the manner of trial-and-error which realizes a proper response of the whole control system.

$$J = \int_{-\infty}^{\infty} (y^T Q y + W^T R W) dt \quad (1)$$

where y is the output or the state quantity of the controlled process, W is the manipulated variable given to the controlled process by the controller, $y^T$ is the transposition of y, and $W^T$ is the transposition of W.

The trial-and-error action is repeatedly performed in the LQ control. Hence, a design of the control system and an adjustment of the plant are very time-consuming. According particularly to the technique disclosed in Japanese Patent Laid-Open Publication No. 2-211906, an interstand transfer lag is approximated by a first-order lag; and the thickness, the tension and the looper height are conceived as state quantities. It is therefore considered that a very high-order state equation be prepared for expressing the controlled process. If the order of the state equation is high, Q and R are hard to adjust.

In addition, the interstand transfer lag should be originally expressed as a dead time element. The transfer lag is, however, approximated by the first-order lag in this technique. Accordingly, a deterioration in terms of an accuracy of the model is also considered. Moreover, according to the method based on the LQ control theory, it is required that an analytically unsolvable Riccati's (differential) equation be solved numerically. There also exists such an inconvenience that a general equation for the optimum control gains containing variables can not be obtained.

Note that a general practice according to a method which does not obtain the general equation but utilizes a gain table is to previously prepare the gain table by seeking the control gains adjusted to properties of the rolled material and rolling conditions and refer to this table when using the control gains. It therefore follows that a determination, a retention and a management of values in the gain table are very time-consuming.

Further, describing all cases in the gain table is almost impossible. There is no alternative but to approximate the gains from a table similar to rolling conditions which do not exist in the gain table, and, therefore, a decline in control performance may be expected.

SUMMARY OF THE INVENTION

It is an object of the present invention, which has been devised to obviate the problems described above, to provide a control apparatus for a continuous hot rolling mill that is capable of actualizing a response with a small amount of overshoot and setting a control gain without requiring numerically solving a Riccati's equation and for using a gain table.

According to the present invention, a control apparatus for continuous hot rolling mills comprises: main-motor speed control units for controlling speeds of main motors for driving the rolling mills, corresponding to a plurality of stands; and roll gap control units for controlling roll gaps. Speed command values for the main-motor speed control units and roll gap values for the roll gap control units are respectively calculated by use of a process model in which an interference system between a thickness of a rolled material and an interstand tension is modeled. The control apparatus further comprises: a setting means for setting variables for expressing the process model, a target thickness value of the rolled material, a target interstand tension value of the rolled material, variables for responses of the thickness and the interstand tension and variables for adjusting the responses of a control system for controlling the thickness and the interstand tension; a control gain arithmetic means for obtaining control gains as numeric values by substituting the set variables into predetermined control gain operation expressions; and a control arithmetic means for calculating the speed command values and the roll gap command values for causing the thickness to follow the target thickness and the interstand tension to follow the target interstand tension by use of the calculated control gains while reducing interaction between the thickness and the interstand tension.

In this case, the continuous hot rolling mill includes loopers between the stands and looper motor speed control units for controlling speeds of motors for driving loopers so that a looper height follows an independent target looper height.

Employed according to this invention is a process model in which an interference system between the thickness of the rolled material and the interstand tension is modeled. At the same time, the control gains are obtained in the form of numeric values by substituting the variables expressing this process model and the variables for representing the set responses into predetermined operation expressions. Further, the speed command values for the main-motor speed control units and the roll gap command values for the roll gap control units are calculated by use of those control gains to make the thickness follow the target thickness value and the interstand tension follow the target interstand tension value respectively while reducing the interaction between the thickness and the interstand tension. Accordingly, the speeds of the main motors act in cooperation with the roll gaps with respect to the control over the thickness of the rolled material and the tension. It is therefore possible to actualize the responses with a small amount of overshoot. Simultaneously, there is eliminated the necessity for numerically solving the Riccati's equation with respect to variations both in state of the rolled material and in operating state and for using the control gain table.

Further, the looper height and the tension are controlled to the independent target values, whereby the interference of the looper height with the tension can be ignored. The order of the model representing the interaction between the thickness and the tension can be decreased, thereby making it possible to keep the accuracy of the model.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENT

The present invention will hereinafter be described in detail by way of an illustrative embodiment.

Figure 1:
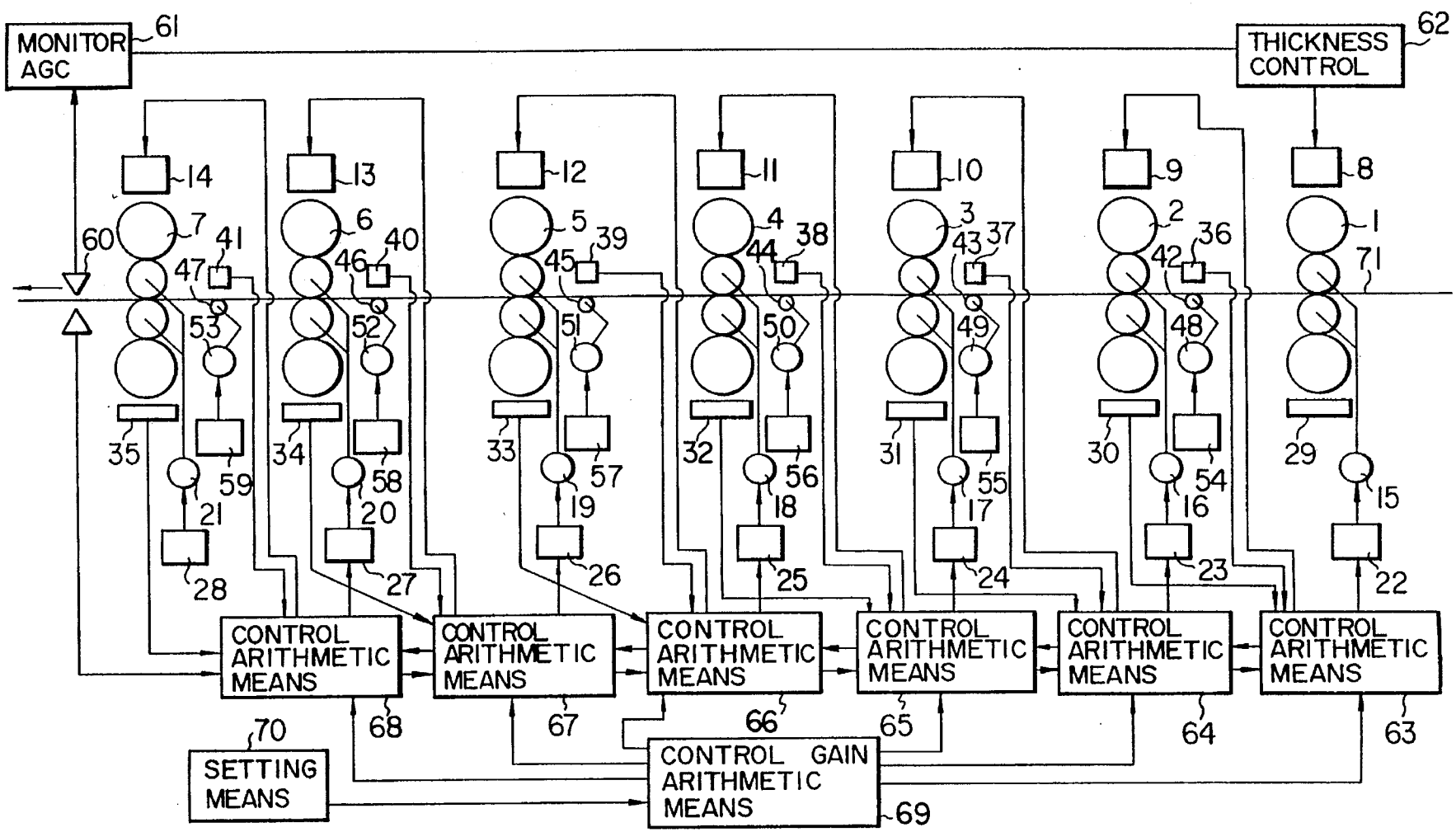
FIG. 1 is a block diagram illustrating a construction of one embodiment of the present invention in combination with a rolling mill.

FIG. 1 is a block diagram showing a configuration of one embodiment of this invention in combination with a rolling mill. Herein, a first stand 1, a second stand 2, . . . , a seventh stand 7 are arranged in tandem. A rolled material 71 is rolled sequentially on these stands. In this instance, a stand number n is set to 7 but generally set such as n=5~7.

These stands are respectively equipped with rolling reduction control units 8~14 serving as roll gap control units and main motors 15~21 for driving rolling mills. The stands further include main-motor speed control units 22~28 for controlling speeds of the main motors 15~21. The stands also have force cells 29~35 for detecting rolling forces.

Interposed between the stands are tension detecting units 36~41 for detecting a tension of the rolled material 71, loopers 42~47 and motors (hereafter called looper motors) 48~53 for driving the loopers. Looper motor speed control units 54~59 are provided corresponding to these looper motors.

Further, an X-ray thickness gauge 60 for measuring a strip thickness is provided on the delivery side of the seventh stand. Based on the measured value thereof, a monitor AGC unit 61 estimates the thickness. A thickness control unit 62 of the first stand calculates a roll gap command value for obtaining a target thickness on the basis of the estimated thickness. The roll gap command value is given to the rolling reduction control unit 8. Provided further are control arithmetic means 63~68 for calculating roll gap command values of the second through seventh stands on the basis of the detected forces of the respective force cells 30~35 of the second through seventh stands, the detected tensions of the tension detecting units 36~41 on the entry sides of these stands and the thickness measured by the X-ray thickness gauge 60. The control arithmetic means 63~68 impart these roll gap command values to the rolling reduction control units 9~14. The control arithmetic means 63~68 also calculate and give speed command values of the main motors to the main-motor speed control units 22~27.

The control arithmetic means 63~68 transfer and receive the information from each other. On the other hand, the control arithmetic means 63~68 receive, from a control gain arithmetic means 69, a control gain required for a calculation to restrain an interaction between the thickness and an interstand tension. This control gain arithmetic means 69 obtains necessary information from a setting means 70 and calculates the control gain.

The following is an explanation of the operation of this embodiment.

The setting means 70 sets parameters needed for calculating the control gain in accordance with rolling conditions and properties of the rolled material. The setting means 70 sets a target thickness value of the rolled material on each stand, a target interstand tension value, variables representing a model of a controlled process, variables for setting the thickness and the interstand tension, and variables for adjusting responses of the control system for controlling the thickness and the interstand tension. The setting means 70 imparts the respective set values to the control gain arithmetic means 69.

The control gain arithmetic means 69 calculates the control gain which will be fully stated later by use of the set parameter values and gives the result to the control arithmetic means 63~68.

Based on the calculated control gain, the detected forces of the second to seventh stands, the detected tensions on the entry sides of these stands and the thickness measured by the X-ray thickness gauge 60, the control arithmetic means 63~68 calculate main motor speed command values of the first to sixth stands and roll gap command values of the second to seventh stands. The thus calculated command values are given to the main motor speed control units 22~28 and the rolling reduction control units 9~14. Note that the seventh stand main motor speed set as a reference speed, a socalled pivotal speed of the whole rolling mill, is in the great majority of cases controlled to a fixed value. The seventh stand main-motor speed control unit 28 is therefore eliminated from an operation terminal of the control.

On the other hand, the looper motor speed control units 54~59 control speeds of the looper motors 48~53 to decrease a deviation between an independent target looper height value and an actual height with respect to the loopers 42~47.

The same construction is used for the control arithmetic means 63~68 and, for simplifying the description, one of them will be explained in detail by use of the controlled process model.

Figure 2:
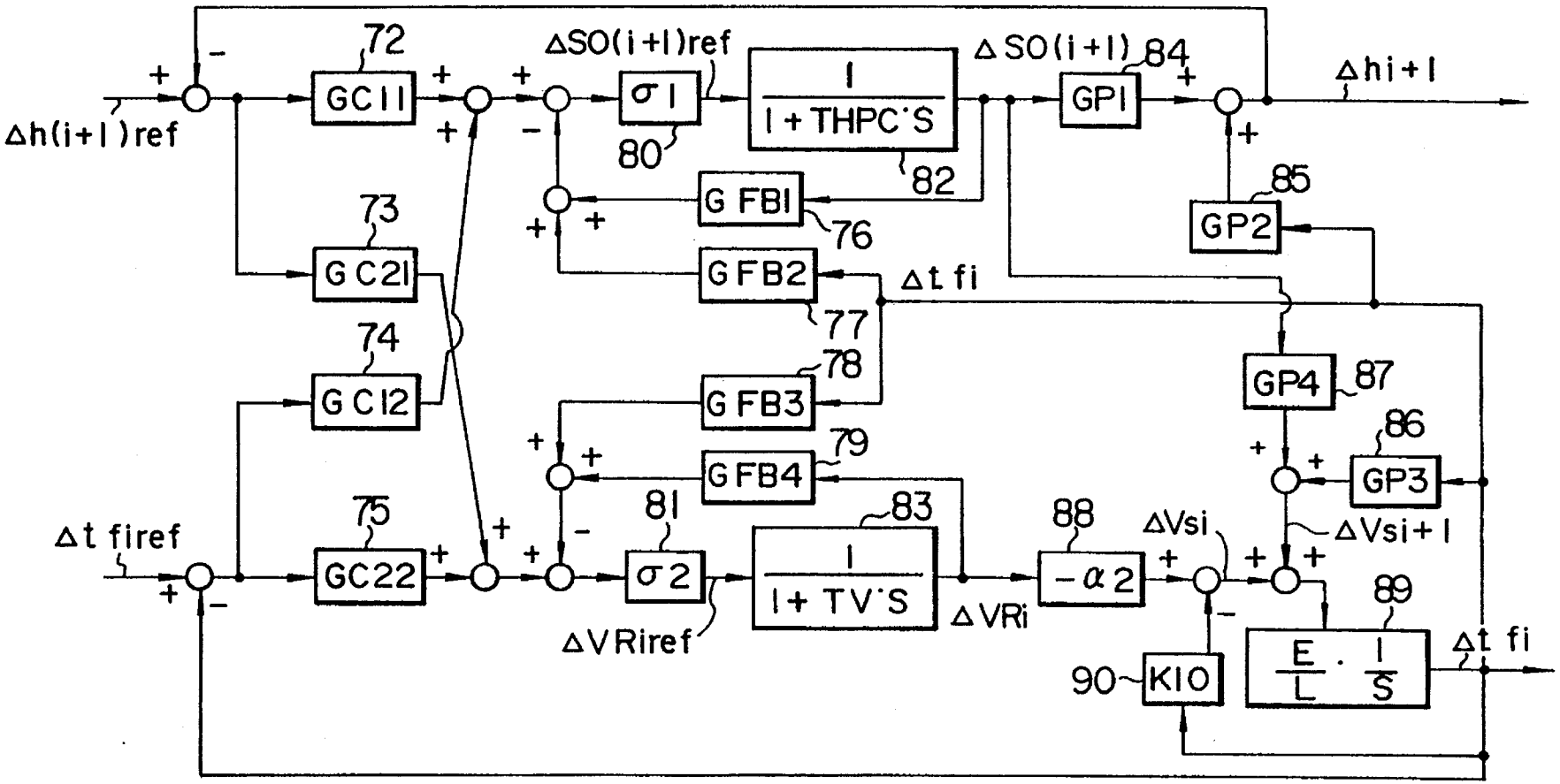
FIG. 2 is a block diagram fully illustrating a construction of the principal portion of one embodiment of the present invention.
Figure 3A:
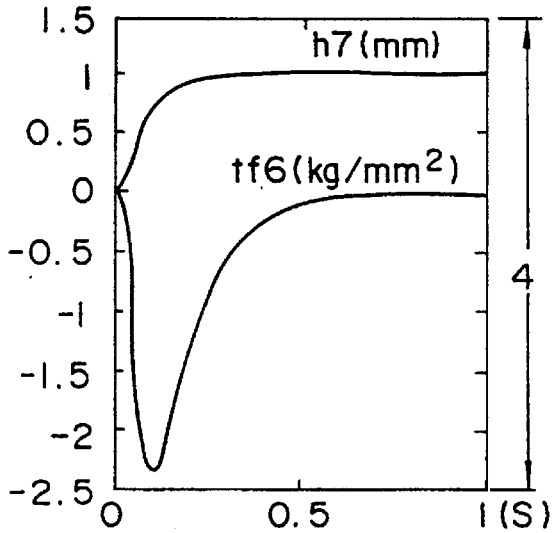
FIGS. 3(*a*)–(*d*) is a graphic chart, showing a relationship between a thickness, a tension and a time, for assistance in explaining the operation of one embodiment of the present invention.
Figure 3B:
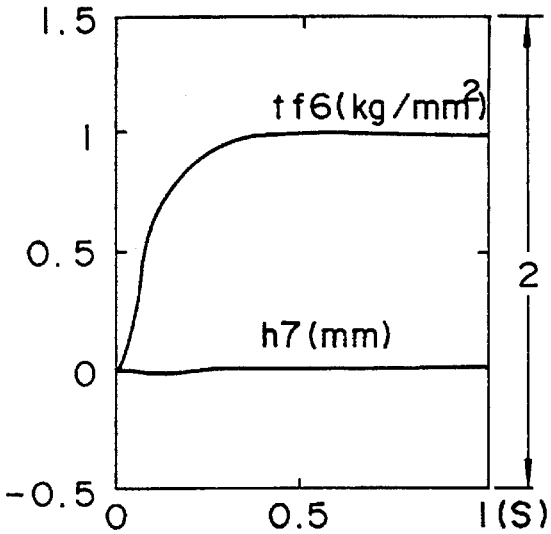
Figure 3C:
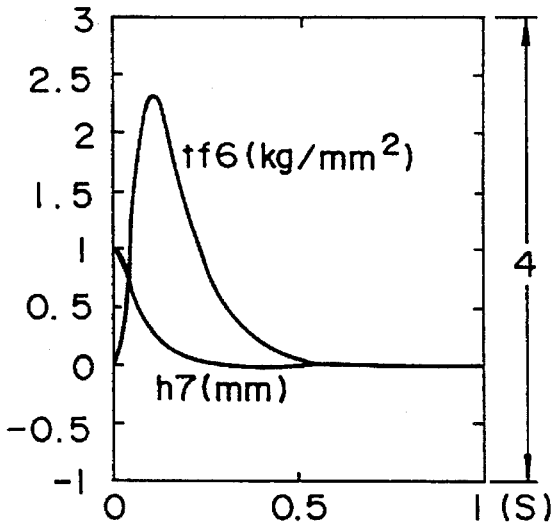
Figure 3D:
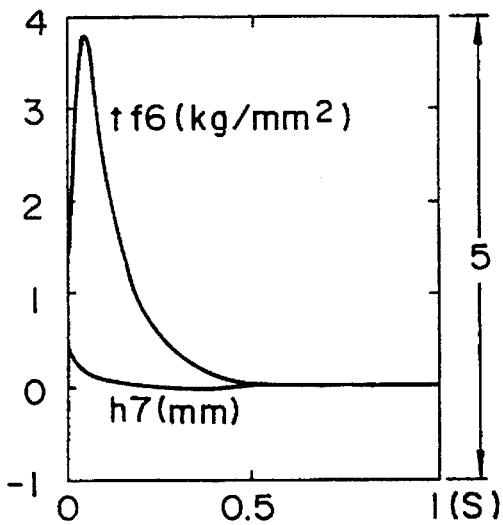

FIG. 2 is a diagram of a control system relative to the sixth and seventh stands among the control systems shown in FIG. 1, illustrating the control arithmetic means 68 and the model of the controlled object thereof. Herein, each state quantity is expressed for linearization by use of a variation Δ from a steady state value.

Referring to FIG. 2, blocks 82~90 are defined as a process model of the controlled object. The block 82 corresponds to the rolling reduction control unit 14 shown in FIG. 1. A response of the rolling reduction control unit 14 is expressed by a first-order lag system of a time constant $TR_{HPC}$. The block 83 corresponds to the main motor speed control unit 27 shown in FIG. 1, and a response thereof is expressed by a first-order lag system of a time constant $T_V$. In the blocks 84~87, rolling phenomena are expressed by influence coefficients to have the following significance:

84: influence coefficient $G_{p1}$ of a roll gap $\Delta S_{0(i+1)}$ with respect to a thickness $\Delta h_{i+1}$,

85: influence coefficient $G_{p2}$ of a tension $\Delta t_{fi}$ with respect to the thickness $\Delta h_{i+1}$,

86: influence coefficient $G_{p3}$ of a tension $t_{fi}$ with respect to an entry speed $\Delta V_{i+1}$ of the rolled material, and

87: influence coefficient of the roll gap $\Delta S_{0(i+1)}$ with respect to the entry speed $\Delta V_{i+1}$ of the rolled material.

The block 88 is an influence coefficient of the main motor speed with respect to a delivery speed of the rolled material. The block 89 is a gain and integrator block and converts the input speed to a tension in a tension generating process. The block 90 is a feedback gain in the tension generating process. A tension generating mechanism is modeled by the blocks 89, 90.

On the other hand, the blocks 72~81 correspond to the control arithmetic means 68 shown in FIG. 1. The blocks 72~75 are integration controllers. The blocks 76~79 are feedback controllers. The block 80 is a coefficient for adjusting a thickness control response. The block 80 is a coefficient for adjusting a tension control response.

The controlled process model of the blocks 82~90 in FIG. 2 is written by the following state equations:

$$\begin{bmatrix} \Delta S_{0(i+1)} \\ \Delta V_{Ri} \\ \Delta t_{fi} \end{bmatrix} = \tag{2}$$

-continued $$\begin{bmatrix} -\frac{1}{T_{HPC}} & 0 & 0 \\ 0 & -\frac{1}{T_V} & 0 \\ \frac{E}{L} G_{P4} & \frac{-E}{L} \alpha_2 & \frac{E}{L} (G_{P3} - K_{10}) \end{bmatrix} \begin{bmatrix} \Delta S_{0(i+1)} \\ \Delta V_{Ri} \\ \Delta t_{f1} \end{bmatrix} + \begin{bmatrix} \frac{1}{T_{HPC}} & 0 \\ 0 & \frac{1}{T_V} \\ 0 & 0 \end{bmatrix} \begin{bmatrix} \Delta S_{0(i+1)ref} \\ \Delta V_{Riref} \end{bmatrix}$$

$$\begin{bmatrix} \Delta h_{i+1} \\ \Delta t_{fi} \end{bmatrix} = \begin{bmatrix} G_{P1} & 0 & G_{P2} \\ 0 & 0 & 1 \end{bmatrix} \begin{bmatrix} \Delta S_{0(i+1)} \\ \Delta V_{Ri} \\ \Delta t_{Fi} \end{bmatrix} \tag{3}$$

where [Δ] prefixed to the symbol represents a variation of the symbol, and [●] marked above the symbol represents a differentiation by the time t. Hence, for instance, $\dot{\Delta t_f}$ implies such as:

$$\dot{\Delta t_f} = d(\Delta t_f)/dt \tag{4}$$

Further, the variables in the state equations have the following meanings:

$K_{10}$: tension feedback coefficient,

E: Young's modulus of the rolled material,

L: interstand distance, $t_f$: forward tension, $V_r$: roll peripheral speed, $\alpha_2$: influence coefficient of the main motor speed with respect to the rolled material speed, $T_v$: time constant of the main motor speed control system, and ref (suffix): command value of the symbol.

The control gains of the blocks 72~79 in FIG. 2 are determined in the manner which follows. The control gains are determined basically by use of the ILQ (Inverse Linear Quadratic) method. As fully stated on pp. 8~17 of '[Generalization of an ILQ Optimum Servo System Design Method] coauthored by Takao Fujii and Suguru Shimomura, the System Association Treatise Journal, Vol. 1, No. 6, 1988, the problem inherent in the LQ control is solved in terms of an inverse problem according to this ILQ method.

On the premise that $\Delta h_{i+1}$ and $\Delta t_f$ are non-interfered by use of the process model expressed by the equations (2) and (3) given above, the control gains of the blocks 72~79 can be given by the following formulae:

72: $G_{C11} = K_{C11}/S$ (*S* is the Laplace operator)

$$K_{C11} = T_{HPC} \bullet \omega_{GC} / G_{P1} \tag{5}$$

73: $G_{C21} = K_{C21}/S$ $$K_{C21} = T_V \bullet \omega_{GC} \bullet G_{P4} / (G_{P1} \bullet \alpha_2) \tag{6}$$

74: $G_{C12} = 0$ (7)

75: $G_{C22} = K_{C22}/S$ $$K_{C22} = -4 \bullet L \bullet \omega_{TC}^2 \bullet T_V / (\alpha_2 \bullet E) \tag{8}$$

76: $G_{FB1} = T_{HPC}$ (9)

77: $G_{FB2}=T_{HPC}\bullet G_{P2}/G_{P1}$ (10)

78: $G_{FB3}=T_V\{E(K_{10}\bullet G_{P1}-G_{P1}\bullet G_{P3}+G_{P2}\bullet G_{P4})-4_{GP1}\bullet L\bullet\omega_{TC}\}/(\alpha_2\bullet G_{P1}\bullet E)$ (11)

79: $G_{FB4}=T_V$ (12)

where $\omega_{GC}$: cut-off frequency (rad/s) of a set response of the thickness control system, and $\omega_{TC}$: cut-off frequency (rad/s) of a set response of the tension control system, the desired values being respectively set.

An adjustment coefficient $\sigma_1$ in the block 80 is determined so that the thickness control system makes a desired response. An adjustment coefficient $\sigma_2$ in the block 81 is determined so that the tension control system makes a desired response. Generally when $\sigma_1$ and $\sigma_2$ are set large, high responses are to be obtained.

The setting means 70 sets the variables $T_{HPC}$, $T_V$, E, $K_{10}$, L, $\alpha_2$, $G_{P1}$, $G_{P2}$, $G_{P3}$ and $G_{P4}$ in the above-mentioned formulae (5)~(12) as variables for expressing the model of the controlled process. The setting means 70 also sets $\omega_{GC}$ and $\omega_{TC}$ as variables for setting responses of the strip thickness on each stand and the interstand tension. The setting means 70 further sets $\sigma_1$ and $\sigma_2$ as variables for adjusting the response of the control system for controlling the strip thickness on each stand and the interstand tension. The set values thereof are transferred to the gain arithmetic means 69.

The control gain arithmetic means 69 substitutes these set values into the formulae (5)~(12) and thus calculates the control gains of the blocks 72~79. The control gains in the form of numeric values are transferred together with $\sigma_1$ and $\sigma_2$ set by the setting means 70 to the control arithmetic means 63~68.

FIG. 3 shows results of simulation of the control system in accordance with this embodiment. This simulates the rolling mill of the seventh stand. It is assumed that a looper height is controlled to a fixed value.

More specifically, FIG. 3(*a*) shows responses of the 7th stand delivery side thickness $h_7$ and the tension $t_{f6}$ (kg/mm$^2$) between the 6th and 7th stands, wherein the 7th stand delivery target thickness value $h_{7ref}$ (mm) is changed stepwise by +1 (mm) when the time t=0.

FIG. 3(*b*) shows responses of the 7th stand delivery thickness $h_7$ and the tension $t_{f6}$ (kg/mm$^2$) between the 6th and 7th stands, wherein the target tension value $t_{f6ref}$ between the 6th and 7th stands is changed stepwise by +1 (kg/mm$^2$) when the time t=0.

FIG. 3(*c*) shows responses of the 7th stand delivery side thickness $h_7$ and the tension $t_{f6}$ (kg/mm$^2$) between the 6th and 7th stands, wherein the 7th stand entry thickness value $H_7$ (mm) is changed stepwise by +1 (mm) when the time t=0.

FIG. 3(*d*) shows responses of the 7th stand delivery side thickness $h_7$ and the tension $t_{f6}$ (kg/mm$^2$) between the 6th and 7th stands, wherein the 7th stand roll gap $S_{07}$ (mm) is changed stepwise by +1 (mm) when the time t=0.

Figure 4A:
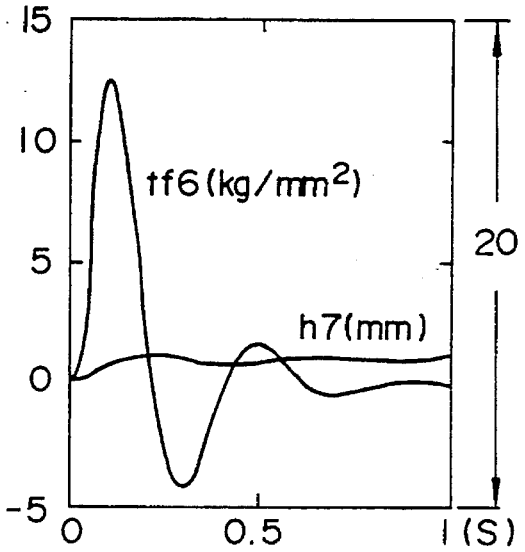
FIG. 4(a) PRIOR ART
FIGS. 4(*a*)–(*d*) is a graphic chart showing a relationship between a thickness, a tension and a time in a conventional control apparatus of a continuous hot rolling mill.
Figure 4:
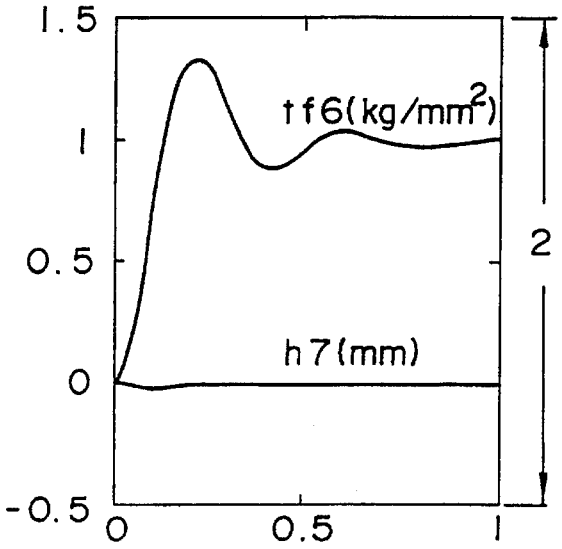
FIG. 4 (b) PRIOR ART
Figure 4:
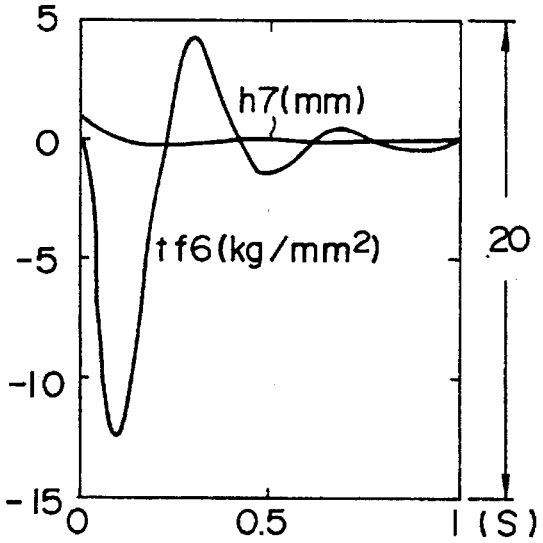
FIG. 4 (c) PRIOR ART
Figure 4:
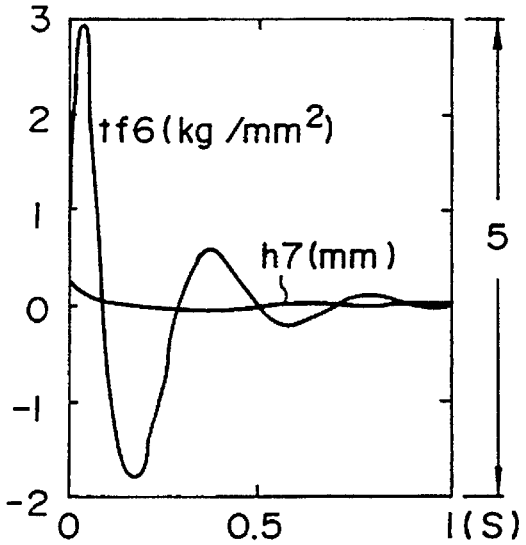
FIG. 4 (d) PRIOR ART

FIG. 4 shows results of simulation to the control system for dependently performing the gauge meter AGC which has hitherto been employed and the interstand tension control based on the PI control under the same conditions as the above-mentioned.

Note that FIGS. 4(*a*)~4(*d*) shows results obtained under the same conditions as those in FIGS. 3(*a*)~3(*d*). It is required that attention be paid to differences in the scales on the axes of ordinates.

As obvious from the results of simulation in FIGS. 3 and 4, overshoots in this embodiment are less than in the conventional example where the thickness and the tension are independently controlled. A settling time therefore apparently becomes short.

Further, the analytically unsolvable Riccati's equation is required to be solved numerically according to the method disclosed in Japanese Patent Laid-Open Publication No. 2-211906. In contrast, in this embodiment, an interference system between the thickness and the interstand tension is modeled. Substituted into the predetermined operation expressions are the variables representing this model, the variables for setting the responses of the thickness and the interstand tension and the variables for adjusting these responses. The control gains are thus obtained in the form of numeric values. Therefore, even when the state of the rolled material and the operating state are varied, the set values may be simply changed. There is no necessity for numerically solving the Riccati's equation. The necessity for using a control gain table is, as a matter of course, eliminated.

Moreover, according to this conventional method, a interstand transfer lag is approximated by a first-order lag, resulting in a decline in terms of accuracy of the model. In accordance with this embodiment, however, the looper height is controlled independently both of the control over the thickness and the tension. Hence, no interference between the looper height and the tension takes place, thereby decreasing the order of the model of the interference system between the thickness and the tension. Accordingly, the decline in the accuracy of the model can be prevented.

Note that the X-ray thickness gauge detects only the 7th stand delivery side thickness but does not detect thicknesses on the delivery sides of the 1st through 6th stands in the embodiment discussed above. However, the thickness on the delivery side of each stand can be estimated without using the thickness gauge.

Namely, if no thickness gauge is prepared, the thickness can be estimated by a gauge meter system as expressed in the following formula:

$$h_i = S_{0i} + \frac{P_i}{M_i} \quad (i = 1\sim7) \tag{13}$$

where $h_1$: ith stand delivery side thickness (mm), $S_{0i}$: ith stand roll gap (mm), $P_i$: ith stand rolling force (ton), and $M_i$: ith stand mill constant (ton/mm)

The rolling force P among them is detected by the force cells 29~35, and the mill constant M can be measured beforehand.

Further, if the thickness gauge is provided on the stand delivery side more upstream than the 7th stand, it is possible to estimate a thickness on the delivery side of the stand disposed more downstream than that stand. In this case, the detected thickness value is lagged by an interstand transfer time, and a downstream stand delivery side thickness is estimated by the arithmetic based on the mass flow definite rule. For instance, if the thickness gauge is provided on the 5th stand delivery side, a 6th stand delivery side thickness is estimated by the following formula:

$$h_6 = \frac{V_6 \times B_6}{V_6 \times b_6}\, h_5 \times e^{-LS} \tag{14}$$

$V_6$: 6th stand entry side material speed (mm/s), $B_6$: 6th stand entry side width (mm), $v_6$: 6th stand delivery side material speed (mm/s), $b_6$: 6th stand entry side width (mm), $h_5$: 5th stand delivery side detected thickness value (mm), $h_6$: 6th stand delivery side thickness (mm), L: rolled material transfer time (s) from the 5th stand delivery side thickness gauge to the 6th stand, S: Laplace operator, and $e^{-LS}$: dead time The interstand tensions are detected respectively by the tension detecting units 36~41 in the embodiment discussed above. If the loopers are interposed between the stands, however, these interstand tensions can be calculated from looper driving motor torques.

More specifically, a relationship between the torques is established as shown in the following formula:

$$T_L=T_T+T_W+T_M+T_A \quad (15)$$

where $T_L$ is the torque which is to be generated by the looper motor, $T_T$ is the torque associated with the tension, $T_W$ is the torque associated with an interstand material weight, $T_M$ is the torque associated with a tare weight of the looper motor, and $T_A$ is the torque for accelerating and decelerating the looper. The torques $T_L$, $T_W$, $T_M$, $T_A$ among them are easily obtained, and the torque $T_T$ associated with the tension is acquired therefrom. Hence, this torque $T_T$ due to the tension is divided by a length of a looper arm, thereby obtaining a tension.

Further, the present invention aims at such a construction that the embodiment discussed above involves the use of the four-high rolling mills with the back-up rolls simply disposed outwardly of the work rolls, and, besides, the loopers interposed between these rolling mills are driven by the motors. The present invention is not, however, limited to this construction. This invention is applicable to a case where the rolling mill may include an intermediate roll, etc., or the looper is hydraulically driven.

The integration controllers (I-controllers) 72~75 shown in FIG. 2 can be replaced by PI-controllers, respectively, thereby a control response can be improved when a disturbance such as a change of an entry thickness, an eccentricity of a roll, or a change of an entry temperature of a strip occurs.

It is apparent that, in this invention, a wide range of different working modes can be formed based on the invention without deviating from the spirit and scope of the invention. This invention is not restricted by its specific working modes except being limited by the appended claims.

What is claimed is:

1. A control apparatus for a continuous hot rolling mill, comprising:

main-motor speed control units for controlling speeds of rolling mill driving main motors, corresponding to a plurality of stands;

roll gap control units for controlling roll gaps, whereby speed command values for said main-motor speed control units and roll gap values for said roll gap control units are respectively calculated by use of a process model in which an interference system between a delivery thickness and a backward interstand tension of a rolled material is modeled;

said process model including means for calculating said delivery thickness and said interstand tension in response to a roll gap command value and a main-motor speed command value, said delivery thickness and said interstand tension being calculated in consideration of interference between said delivery thickness and said interstand tension;

a setting means for setting variables for expressing said process model, a target thickness value of said rolled material, a target interstand tension value of said rolled material, variables for responses of said thickness and said interstand tension and variables for adjusting responses of a control system for controlling said thickness and said interstand tension;

a control gain arithmetic means for obtaining control gains as numeric values for respective stands by substituting said set variables into predetermined control gain operation expressions; and a plurality of control arithmetic means for calculating said speed command values and said roll gap command values for causing said thickness to follow said target thickness value and said interstand tension to follow said target interstand tension value while reducing an interaction between said thickness and interstand tension by use of said control gains calculated by said control gain arithmetic means, each of said control arithmetic means being provided for each of said stands.

2. The control apparatus as set forth in claim 1, wherein said setting means sets parameters needed for calculating a control gain in accordance with a rolling condition and property of the rolled material.

3. The control apparatus as set forth in claim 1, wherein each of said control arithmetic means calculates a speed command value for a corresponding stand on the basis of a corresponding control gain calculated by said control gain arithmetic means, a detected force of said corresponding stand, and a detected tension on an entry side of said corresponding stand.

4. The control apparatus as set forth in claim 1, wherein a speed command value for a whole rolling mill is given to the main-motor speed control unit of a final stand.

5. The control apparatus as set forth in claim 1, wherein said apparatus further comprises thickness control means for controlling a roll gap of a first stand on the basis of a detected delivery thickness of a final stand.

6. The control apparatus as set forth in claim 1, wherein said continuous hot rolling mill includes loopers between said stands and looper motor speed control units for controlling speeds of motors for driving loopers so that a looper height follows up a target looper height set irrespective of the control over said thickness and said tension.

* * * * *